US008503914B2

(12) United States Patent
Ohashi et al.

(10) Patent No.: US 8,503,914 B2
(45) Date of Patent: Aug. 6, 2013

(54) TONER DISPENSING MEMBER AND TONER DISPERSING MECHANISM PROVIDED THEREWITH

(75) Inventors: Hiroaki Ohashi, Osaka (JP); Ryoji Nishimura, Osaka (JP); Masahiro Kashimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 192 days.

(21) Appl. No.: 13/035,160

(22) Filed: Feb. 25, 2011

(65) Prior Publication Data

US 2011/0229211 A1 Sep. 22, 2011

(30) Foreign Application Priority Data

Mar. 17, 2010 (JP) ..... 2010-060535

(51) Int. Cl.
*G03G 15/08* (2006.01)

(52) U.S. Cl.
USPC ..... 399/255

(58) Field of Classification Search
USPC ..... 399/119, 258, 260, 254–256
See application file for complete search history.

(56) References Cited

U.S. PATENT DOCUMENTS

| | | | | |
|---|---|---|---|---|
| 5,629,758 | A * | 5/1997 | Kageyama et al. | 399/263 |
| 6,415,126 | B2 * | 7/2002 | Kaneshige et al. | 399/256 |
| 7,801,469 | B2 * | 9/2010 | Uezono | 399/263 |
| 7,848,682 | B2 * | 12/2010 | Tanaka | 399/254 |
| 7,941,073 | B2 * | 5/2011 | Takagi et al. | 399/120 |
| 8,121,524 | B2 * | 2/2012 | Sakoh et al. | 399/262 |

FOREIGN PATENT DOCUMENTS

| | | |
|---|---|---|
| JP | 53-100206 | 9/1978 |
| JP | 4-139470 | 5/1992 |
| JP | 6-59577 | 3/1994 |
| JP | 7-110620 | 4/1995 |
| JP | 9-211955 | 8/1997 |
| JP | 2004-45904 | 2/2004 |
| JP | 2006-251512 | 9/2006 |
| JP | 2007-147893 | 6/2007 |
| JP | 2007-171940 | 7/2007 |
| JP | 2008-83287 | 4/2008 |
| JP | 2008-129210 | 6/2008 |

* cited by examiner

*Primary Examiner* — Robert Beatty
(74) *Attorney, Agent, or Firm* — Smith, Gambrell & Russell, LLP

(57) ABSTRACT

Provided is a toner dispersing member including a rotary shaft and dispersing protrusions formed of a flexible film member wound along an outer peripheral surface of the rotary shaft, the flexible film member including a large number of cuts formed on one side thereof and are directed outward. The toner dispersing member is rotated about the rotary shaft so that a lump of toner coming into contact with the dispersing protrusions is dispersed.

17 Claims, 11 Drawing Sheets

TONER DISPENSING MEMBER AND TONER DISPERSING MECHANISM PROVIDED THEREWITH

This application is based upon and claims the benefit of priority from the corresponding Japanese Patent Application No. 2010-60535 filed on Mar. 17, 2010, the entire contents of which are incorporated herein by reference.

BACKGROUND OF THE INVENTION

1. Field of the Invention

The present invention relates to a toner dispersing mechanism, which is mounted to an image forming apparatus such as an electrophotographic copier, a printer, and a facsimile, for dispersing toner replenished from a toner storage container such as a hopper and a container into a developing device.

2. Description of Related Art

Conventionally, for the facilitation of maintenance, a predetermined amount of toner is filled in advance into the developing device mounted to the image forming apparatus, and the developing device itself is replaced when the toner is depleted. However, the developing device cannot be frequently replaced from an economic viewpoint, and a toner capacity of the developing device is inevitably increased for performing image formation on many sheets to some extent. Thus, the above-mentioned developing device is difficult to achieve downsizing. Therefore, in order to achieve the downsizing of the developing device, there has been proposed a developing device of a type, to which toner is supplied from outside.

In the developing device of the toner supply type, a lump of toner is sometimes replenished into the developing device when toner fluidity is reduced owing to use environments, and the like. Thus, there is such a risk that the mixing property between the lump of toner and developer existing in the developing device is deteriorated and a developer thin layer formed on a developing roller is disturbed, with the result that image failures such as an image density unevenness and fogging may occur.

As counter measures, there have been proposed various technologies for suppressing occurrence of the image failures by preceding dispersion of the toner which is to be replenished into the developing device, through uses of a bristle brush roller and a sponge roller. For example, as disclosed in the first and second related arts, there has been known a developing device in which a toner replenishing brush is arranged between a toner hopper and the developing device. Further, as disclosed in the third related art, there has been known a developing device in which a sponge-like toner replenishing roller and a charging brush roller for preventing clogging of the toner replenishing roller are arranged between the toner hopper and the developing device.

However, there are such risks that bristle loss may occur when the bristle brush roller is used as the toner dispersing member as in the first and second related arts, and sponge tear-off may occur when the sponge roller is used as in the third related art. In those cases, there is a problem in that waste of a torn-off sponge and lost bristles may enter the developing device to be caught in a gap between a developing roller and a regulating blade (developer regulating portion), thereby generating an image with vertical white streaks.

SUMMARY OF THE INVENTION

An object of the present invention is to provide a toner dispersing member and a toner dispersing mechanism provided therewith, the toner dispersing member putting toner replenished from a toner storage container into a dispersed state with a simple structure which is free from risks of bristle loss, tear-off, and the like.

A toner dispersing member according to an aspect of the present invention includes a rotary shaft and a large number of dispersing protrusions formed on an outer peripheral surface of the rotary shaft. The toner dispersing member is rotated about the rotary shaft so that a lump of toner coming into contact with the dispersing protrusions is dispersed. The dispersing protrusions are formed by winding a flexible film member having large number of cuts which are formed on one side thereof along the outer peripheral surface of the rotary shaft, while being directed outward.

Further features and advantages of the present invention will become apparent from the description of embodiments given below.

DETAILED DESCRIPTION OF PREFERRED EMBODIMENTS

Figure 1:
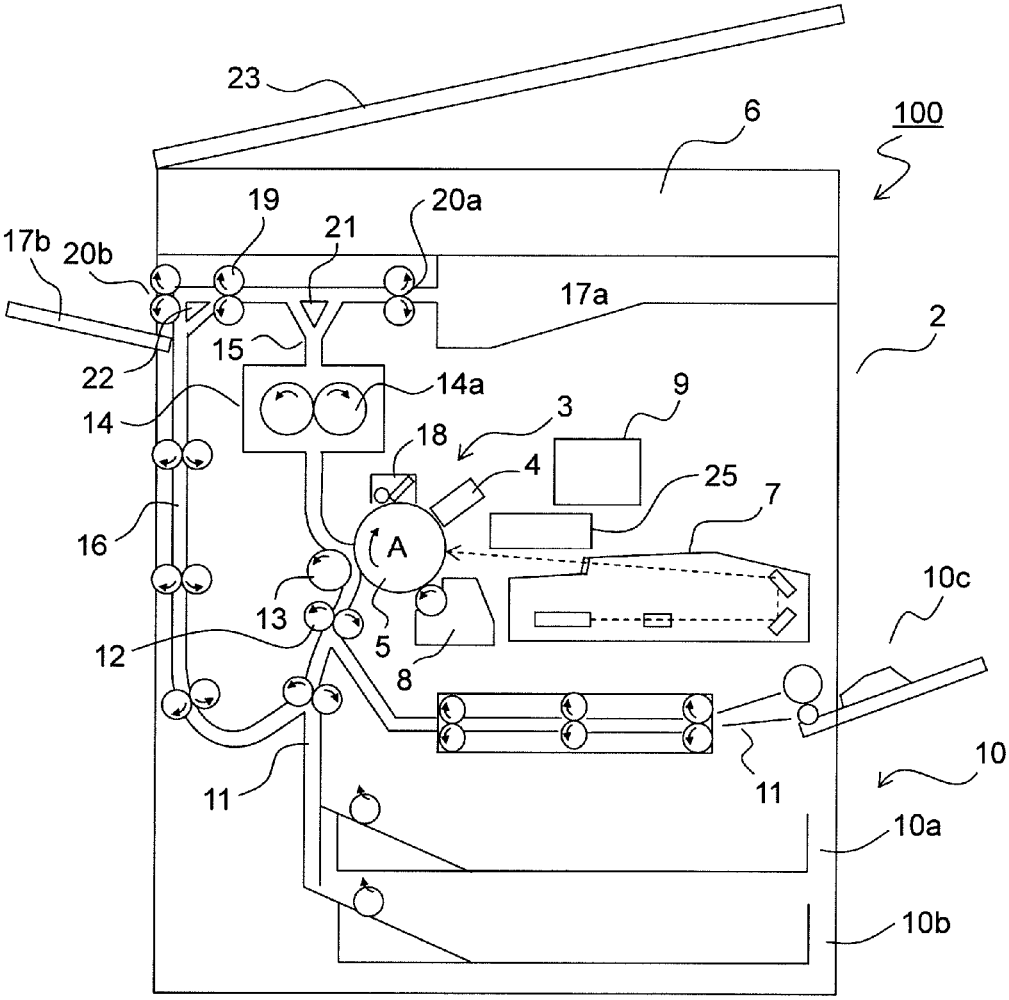
FIG. 1 is a schematic structural view of an entire structure of an image forming apparatus to which a toner dispersing mechanism according to an embodiment of the present invention is mounted.

In the following, description is made of embodiments of the present invention with reference to the drawings. FIG. 1 is a schematic structural view of an image forming apparatus provided with a toner supply container according to an embodiment of the present invention. In FIG. 1, the image forming apparatus is denoted by reference numeral 100, which is a digital composite apparatus as an example. In the image forming apparatus 100, at the time of copying operation, in an image forming portion 3 in a composite apparatus main unit 2, a charging unit 4 uniformly charges a photosensitive drum 5 rotated in a direction A in the figure. Next, a laser beam emitted from an exposure device (laser scanning unit, or the like) 7 which is based on image data of an original document read in an image reading portion 6 forms an electrostatic latent image on the photosensitive drum 5. Then, a developing device 8 causes toner to adhere to the electrostatic latent image so as to form a toner image. The toner is supplied from a toner container 9 to the developing device 8 through intermediation of an intermediate hopper 25.

To the photosensitive drum 5 having a toner image formed thereon as just described above, sheets are conveyed at a predetermined timing from a sheet feeding mechanism 10 to the image forming portion 3 by way of a sheet conveying path 11 and a registration roller pair 12. Next, in the image forming portion 3, a transfer roller 13 (image transfer portion) transfers the toner image on a surface of the photosensitive drum 5 to each of the sheets. Then, each of the sheets having the toner images transferred thereon is separated from the photosensitive drum 5 and conveyed into a fixing portion 14 having a fixing roller pair 14*a*, and the toner images are fixed. The sheets passing the fixing portion 14 are sent into another sheet conveyance path 15 branched into a plurality of directions, and then are routed into different conveying directions by path switching mechanisms 21 and 22 provided at branch points on the sheet conveyance path 15 and having a plurality of path switching guides. The sheets thus routed are delivered as they are (or after being sent into a sheet conveyance path 16 so as to undergo double-face copying) onto a sheet delivery portion constituted by a first delivery tray 17*a* and a second delivery tray 17*b* through a delivery roller pair 20*a* or a delivery roller pair 20*b*.

Further, although not shown, a destaticizing device for removing residual charge on the surface of the photosensitive drum 5 is provided on a downstream side of a cleaning device 18. Further, the sheet feeding mechanism 10 is detachably attached to the composite apparatus main unit 2, and includes a plurality of sheet feeding cassettes 10*a* and 10*b* for receiving the sheets and a manual sheet feeding mechanism (bypass unit) 10*c* provided thereabove. Through intermediation of the sheet conveyance path 11, the cassettes and mechanism communicate to the image forming portion 3 constituted by the photosensitive drum 5, the developing device 8, and the like. At an upper end of the image reading portion 6, there is provided an openable/closable platen (original document presser) 23 capable of pressing and holding an original document placed on a contact glass.

Specifically, the sheet conveyance path 15 is first branched left and right on a downstream side of the fixing roller pair 14*a*, and one branch path (path directed right in FIG. 1) communicates to the first delivery tray 17*a*. Meanwhile, another branch path (path directed left in FIG. 1) is branched up and down by way of a conveyance roller pair 19, and derivative one branch path (path directed left in FIG. 1) communicates to the second delivery tray 17*b*. In contrast, derivative another branch path (path directed down in FIG. 1) communicates to the sheet conveyance path 16.

Figure 2:
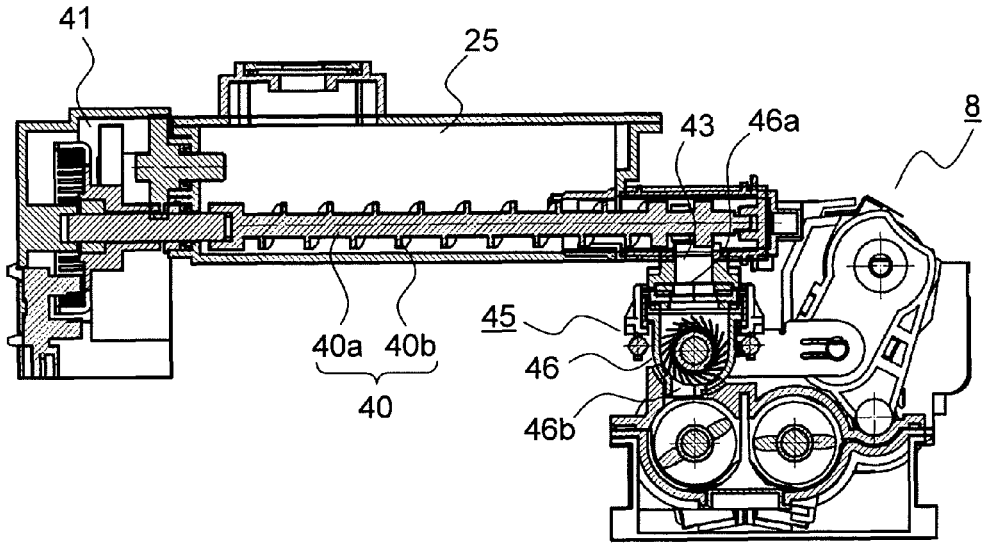
FIG. 2 is a sectional view illustrating a toner replenishing path according to the embodiment of the present invention from an intermediate hopper to a developing device.
Figure 3:
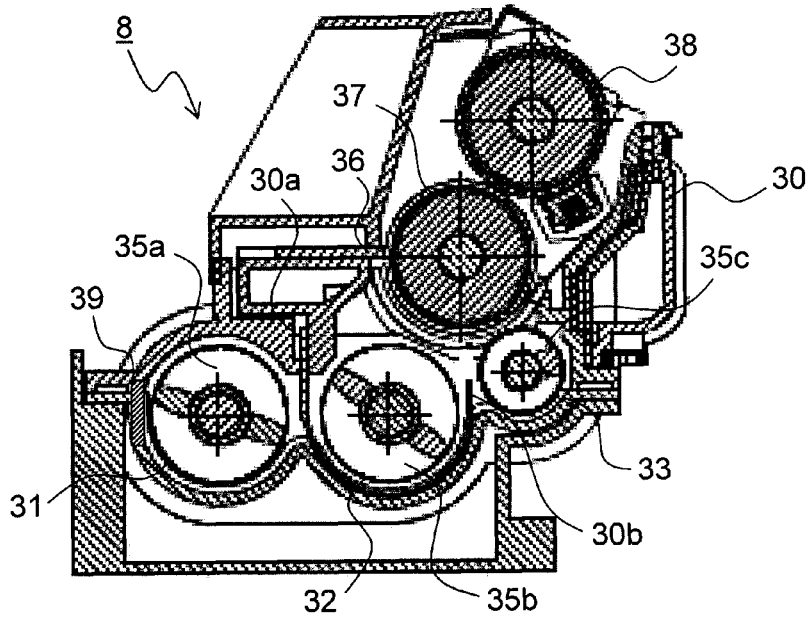
FIG. 3 is an enlarged sectional view of the developing device according to the embodiment of the present invention, illustrated in FIG. 2.

FIG. 2 is a sectional view illustrating a toner replenishing path from the intermediate hopper to the developing device, and FIG. 3 is a side sectional view of the developing device. Note that, FIG. 2 illustrates a state in which the developing device is viewed from a rear surface side of FIG. 1, and an arrangement of the developing device 8 and the intermediate hopper 25 is left-right reversal with respect to that illustrated in FIG. 1.

As illustrated in FIG. 2, a stirring paddle (not shown) and a conveying screw 40 are arranged in the intermediate hopper 25. Rotation of the stirring paddle in a predetermined direction causes toner stored in the intermediate hopper 25 to be stirred and guided to the conveying screw 40.

The conveying screw 40 has a helical blade 40*b* formed on an outer peripheral surface of a spindle 40*a*. One end of the spindle 40*a* is coupled to a gear train. When a drive mechanism 41 rotationally drives the conveying screw 40, toner is supplied from a toner supply port 43 provided in a bottom surface of the intermediate hopper 25 into the developing device 8 through intermediation of a toner dispersing mechanism 45.

Next, detailed description is made of the structure of the developing device. As illustrated in FIG. 3, the developing device 8 is provided with a developing container 30 in which a two-component developer (hereinafter, simply referred to as developer) is stored. The developing container 30 is partitioned into a stirring/conveying chamber 31, a supplying/conveying chamber 32, and a collecting/conveying chamber 33 by partition walls 30*a* and 30*b*. In the stirring/conveying chamber 31 and the supplying/conveying chamber 32, there are respectively and rotatably arranged a stirring/conveying screw 35*a* and a supplying/conveying screw 35*b* for stirring toner (positively-charged toner) to be supplied from the toner container 9 (refer to FIG. 1) through intermediation of the intermediate hopper 25 (refer to FIG. 2) after mixing the toner with carrier so that the toner is charged. Further, in the collecting/conveying chamber 33, there is rotatably arranged a collecting/conveying screw 35*c* for conveying developer peeled off from a magnetic roller 37 (described later).

Then, the developer is conveyed in an axial direction (directions to a front side and to a back side of the drawing sheet of FIG. 3) while being stirred by the stirring/conveying screw 35*a* and the supplying/conveying screw 35*b*, and circulates between the stirring/conveying chamber 31 and the supplying/conveying chamber 32 through a developer passage (not shown) formed at both end portions of the partition wall 30*a*. Further, the developer peeled off from the magnetic roller 37

(described later) is conveyed in the axial direction in the collecting/conveying chamber 33 by the collecting/conveying screw 35*c*, and joins developer in the supplying/conveying chamber 32 from a communication portion (not shown) formed at one end of the partition wall 30*b*. That is, the stirring/conveying chamber 31, the supplying/conveying chamber 32, the collecting/conveying chamber 33, the developer passage, and the communication portion constitute a developer circulation path in the developing container 30.

The developing container 30 extends diagonally right above in FIG. 2. In the developing container 30, the magnetic roller 37 is arranged above the supplying/conveying stirring screw 35*b*, and a developing roller 38 is arranged diagonally right above the magnetic roller 37 in a facing manner. The developing roller 38 faces the photosensitive drum 5 (refer to FIG. 1) on an opening side (right side of FIG. 2) of the developing container 30. About respective rotary shafts, the magnetic roller 37 is rotated in a clockwise direction in the figure, and the developing roller 38 is rotated in a counterclockwise direction in the figure.

In the stirring/conveying chamber 31, there is arranged a toner density sensor 39 so as to face the stirring/conveying screw 35*a*. As the toner density sensor 39, there is used a magnetic permeability sensor for detecting a magnetic permeability of the two-component developer constituted by toner and a magnetic carrier in the developing container 30. Here, a toner density refers to a ratio of the toner to the magnetic carrier in the developer (T/C). In this embodiment, the toner density sensor 39 detects the magnetic permeability of the developer and outputs a voltage value corresponding to a detection result thereof to a control portion (not shown). Then, the toner density is determined based on an output value from the toner density sensor 39. The control portion sends a control signal to a drive mechanism 41 (refer to FIG. 2) in accordance with the determined toner density, and supplies a predetermined amount of toner from a toner replenishing port into the developing container 30.

The sensor output value varies in accordance with the toner density. Specifically, the ratio of the toner to the magnetic carrier becomes higher in proportion to the toner density, and the output value decreases due to an increase in percentage of the non-magnetic toner. Meanwhile, the ratio of the toner to the carrier becomes lower in reverse proportion to the toner density, and the output value increases due to an increase in percentage of the magnetic carrier.

The magnetic roller 37 is constituted by a non-magnetic rotary sleeve rotated in the clockwise direction in FIG. 2, and a fixed magnet body having a plurality of magnetic poles enclosed in the rotary sleeve.

The developing roller 38 is constituted by a cylindrical developing sleeve rotated in the counterclockwise direction in FIG. 2, and a developing-roller-side magnetic pole fixed in the developing sleeve. The magnetic roller 37 and the developing roller 38 face each other with a predetermined gap at a facing position thereof. The developing-roller-side magnetic pole has an opposite polarity to the opposing magnetic poles (main pole) of the fixed magnet body.

Further, the developing container 30 is provided with an ear-breaking blade 36 attached along a longitudinal direction of the magnetic roller 37 (directions to the front side and to the back side of the drawing sheet of FIG. 2). In a rotational direction of the magnetic roller 37 (clockwise direction in the figure), the ear-breaking blade 36 is positioned on an upstream side relative to the facing position of the developing roller 38 and the magnetic roller 37. A slight gap is formed between a distal end portion of the ear-breaking blade 36 and a surface of the magnetic roller 37.

The developing roller 38 is applied with a direct-current voltage (hereinafter, referred to as $V_{slv}$ (DC)) and an alternating-current voltage (hereinafter, referred to as $V_{slv}$ (AC)), and the magnetic roller 37 is applied with a direct-current voltage (hereinafter, referred to as $V_{mag}$ (DC)) and an alternating-current voltage (hereinafter, referred to as $V_{mag}$ (AC)). Those direct-current voltages and alternating-current voltages are applied to the developing roller 38 and the magnetic roller 37 from a developing bias power source by way of a bias control circuit (both of which are not shown).

As described above, the developer circulates in the stirring/conveying chamber 31 and the supplying/conveying chamber 32 in the developing container 30 while being stirred by the stirring/conveying screw 35*a* and the supplying/conveying screw 35*b* so that the toner is charged, and the developer is conveyed to the magnetic roller 37 by the supplying/conveying screw 35*b*. Then, a magnetic brush (not shown) is formed on the magnetic roller 37. The magnetic brush on the magnetic roller 37 is regulated in layer-thickness by the ear-breaking blade 36, and then conveyed to a facing portion of the magnetic roller 37 and the developing roller 38. The magnetic brush forms a toner thin layer on the developing roller 38 through use of a potential difference ΔV between $V_{mag}$ (DC) applied to the magnetic roller 37 and $V_{slv}$ (DC) applied to the developing roller 38 and a magnetic field.

Although varying in accordance with resistance of the developer, a difference in rotational speed of the magnetic roller 37 and the developing roller 38, and the like, a toner layer thickness on the developing roller 38 may be controlled with ΔV. The toner layer on the developing roller 38 increases together with an increase of ΔV, and decreases together with a decrease of ΔV. A range of from approximately 100 V to 350 V is generally appropriate for ΔV at the time of development.

Rotation of the developing roller 38 causes the toner thin layer formed on the developing roller 38 by the magnetic brush to be conveyed to a facing portion of the photosensitive drum 5 and the developing roller 38. The developing roller 38 is applied with $V_{slv}$ (DC) and $V_{slv}$ (AC), and hence potential difference between the developing roller 38 and the photosensitive drum 5 causes the toner to fly to a photosensitive-drum-5 side. In this manner, the electrostatic latent image on the photosensitive drum 5 is developed.

Toner left without being used for development is re-conveyed to the facing portion of the developing roller 38 and the magnetic roller 37, and is collected by the magnetic brush on the magnetic roller 37. Next, the magnetic brush is peeled off from the magnetic roller 37 at a homopolar portion of the fixed magnet body, and then drops into the collecting/conveying chamber 33. The developer in the collecting/conveying chamber 33 is conveyed in the axial direction by the collecting/conveying screw 35*c*, and joins the developer in the supplying/conveying chamber 32 from a communication portion.

After that, based on an output of the toner density sensor 39, a predetermined amount of toner is replenished from the toner replenishing port, and the toner and the developer integrate into a two-component developer uniformly re-charged at an appropriate toner density during circulation between the supplying/conveying chamber 32 and the stirring/conveying chamber 31. The developer is re-supplied onto the magnetic roller 37 by the supplying/conveying screw 35*b* so as to form the magnetic brush, and conveyed to the ear-breaking blade 36.

Figure 4:
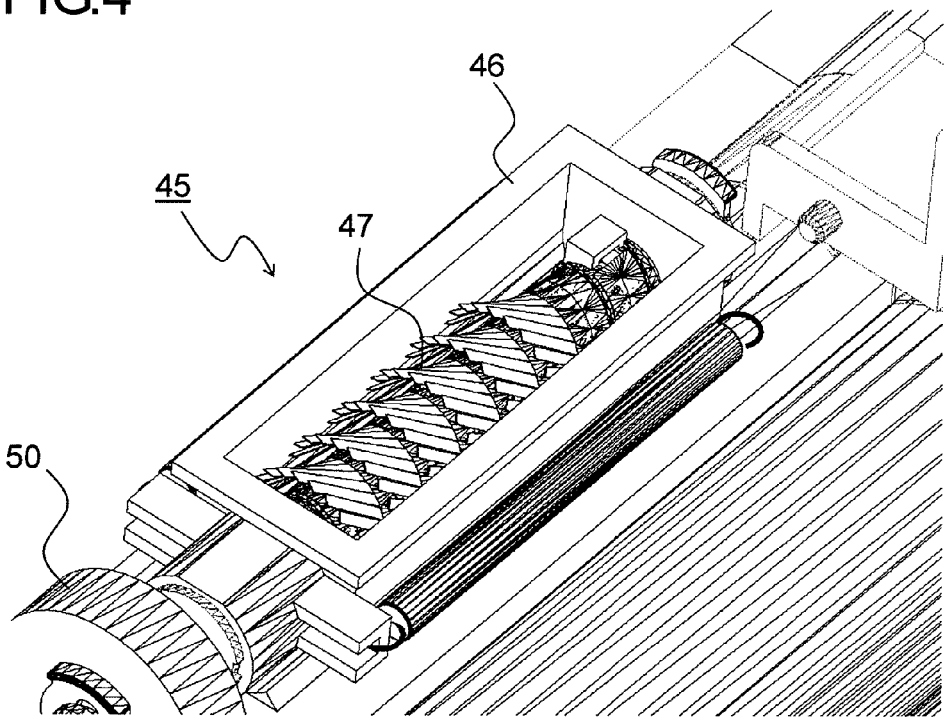
FIG. 4 is a perspective view of the toner dispersing mechanism according to the embodiment of the present invention.
Figure 5:
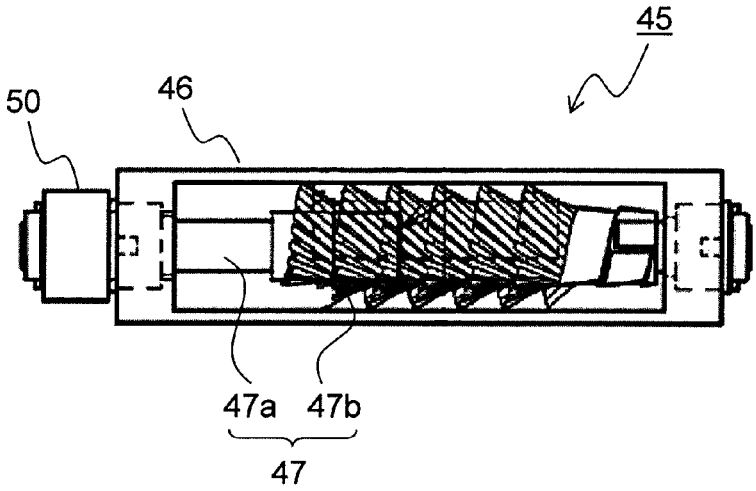
FIG. 5 is a plan view of the toner dispersing mechanism according to the embodiment of the present invention.

FIG. 4 is a perspective view of a toner dispersing mechanism, and FIG. 5 is a plan view of the same. With reference to FIGS. 2, 4, and 5, description is made of a structure of the toner dispersing mechanism. The toner dispersing mechanism 45 is constituted by a housing 46 and a toner dispersing member 47 rotatably supported in the housing 46. Note that, for the sake of convenience in description, FIGS. 4 and 5 illustrate a state in which an inside of the housing 46 is visible with the upper surface thereof being open.

As illustrated in FIG. 2, a toner injection port 46*a* is formed in the upper surface of the housing 46, and a toner discharge port 46*b* communicating to the toner replenishing port of the developing device 8 is formed in a lower surface of the housing 46. When a predetermined amount of toner is injected from the toner injection port 46*a* into the toner dispersing mechanism 45 in accordance with the output of the toner density sensor 39, a lump of the toner is dispersed by rotation of the toner dispersing member 47 and then discharged from the toner discharge port 46*b*, with the result of being replenished into the developing device 8. Further, to the toner injection port 46*a*, there is attached a shutter member (not shown) which opens in conjunction with attachment of the intermediate hopper 25 and closes in conjunction with detachment of the intermediate hopper 25.

The toner dispersing member 47 is provided with a large number of dispersing protrusions 47*b* made of an elastic material on an outer peripheral surface of a rotary shaft 47*a*. One end of the rotary shaft 47*a* extends to an outside of the housing 46, at which a drive input gear 50 is fixed. The drive input gear 50 is coupled to the gear train in the drive mechanism 41 (refer to FIG. 2). Further, a distal end of each of the dispersing protrusions 47*b* is arranged so as to come into contact with an opening rim of the toner discharge port 46*b*.

Figure 6:
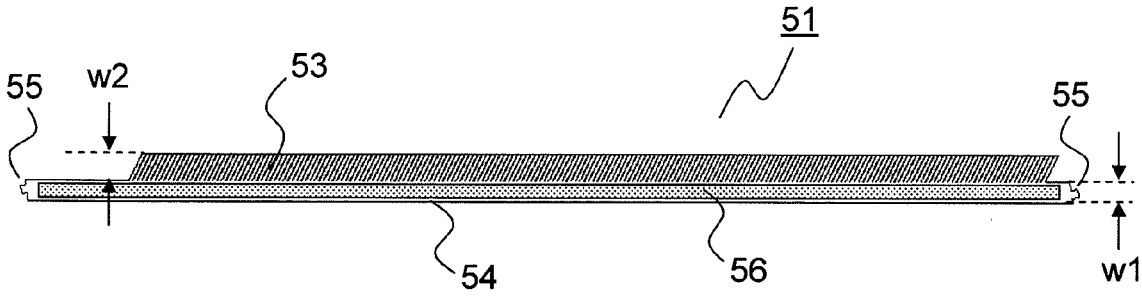
FIG. 6 is a developed view of a film member used for a toner dispersing member according to a first embodiment of the present invention.
Figure 7:
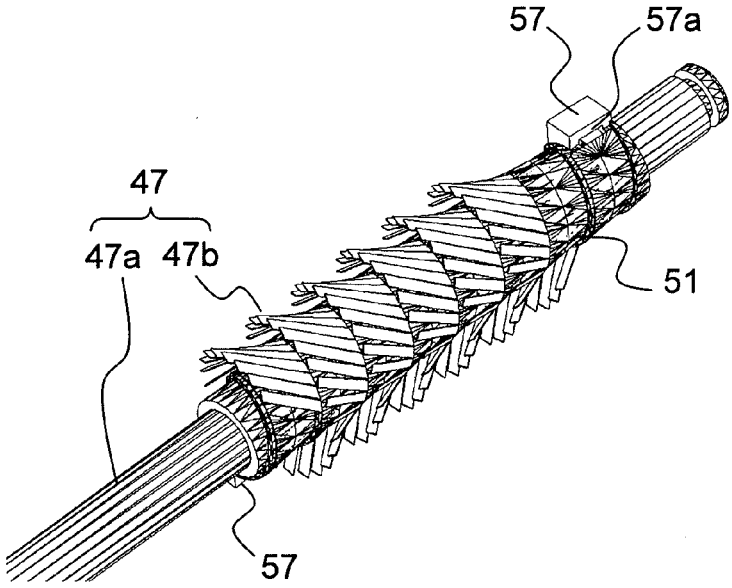
FIG. 7 is a perspective view of the toner dispersing member according to the first embodiment of the present invention.

FIG. 6 is a developed view of the dispersing protrusions used for the toner dispersing member according to a first embodiment of the present invention, and FIG. 7 is a perspective view of the toner dispersing member constituted by the dispersing protrusions of FIG. 6 helically wound about the rotary shaft. In the toner dispersing member 47 in this embodiment, a ribbon-like film member 51 has a large number of cuts 53 formed on one side in the longitudinal direction (upper side of FIG. 6), and a fixation portion 54 includes a part which is free from the cuts 53, and the dispersing protrusions 47*b* are constituted by the cuts 53 directed outward and the film member 51 helically wound along an outer peripheral surface of the rotary shaft 47*a*.

As illustrated in FIG. 6, the cuts 53 are formed not perpendicularly but diagonally with respect to a longitudinal direction of the film member 51. With this, when the film member 51 is wound along the outer peripheral surface of the rotary shaft 47*a*, the part provided with the cuts 53 rises at a certain angle with respect to the rotary shaft 47*a*. Thus, the dispersing protrusions 47*b* may be uniformly and easily formed without being manually spread. The rising angle of the dispersing protrusions 47*b* with respect to the rotary shaft 47*a* may be arbitrarily adjusted by means of an angle of the cuts 53.

Further, engagement protrusions 55 are formed at both end portions of the film member 51, and engagement portions 57 which undergo engagement of the engagement protrusions 55 are protrudingly provided at two points on the outer peripheral surface of the rotary shaft 47*a*. Further, a double-faced tape 56 is applied over the entire region in the longitudinal direction of the fixation portion 54 of the film member 51. At the time of assembly of the toner dispersing member 47, the engagement protrusion 55 at one end of the film member 51 is inserted into a slit 57*a* of one of the engagement portions 57, and the film member 51 is attached with the double-faced tape 56 while being wound about the rotary shaft 47*a*. Lastly, the engagement protrusion 55 at another end is inserted into a slit 57*a* of another of the engagement portions 57. In this manner, the film member 51 may be easily fixed to the rotary shaft 47*a*.

According to the structure in this embodiment, when rotation of the toner dispersing member 47 is timed to injection of toner from the intermediate hopper 25 (refer to FIG. 2) into the toner injection port 46*a*, the distal ends of the dispersing protrusions 47*b* rock by being brought into contact with an inner surface of the housing 46 and the opening rim of the toner discharge port 46*b*. Thus, a lump of toner having entered the housing 46 from the toner injection port 46*a* may be efficiently dispersed to particles.

Further, the dispersing protrusions 47*b* are formed of the film member 51, and hence bristle loss or sponge tear-off does not occur like the cases of a bristle brush roller and a sponge roller. Thus, a toner dispersing member excellent in durability is obtained. In addition, there is no risk that foreign matter derived from the toner dispersing member 47 enters the developing container 30, and hence image failures such as a void image are effectively prevented, which are caused by foreign matter clogging the gap between the ear-breaking blade 36 and the magnetic roller 37. Preferred examples of a material for the film member 51 include a PET film and a urethane sheet which are excellent in flexibility and restorability (elasticity).

Figure 8:
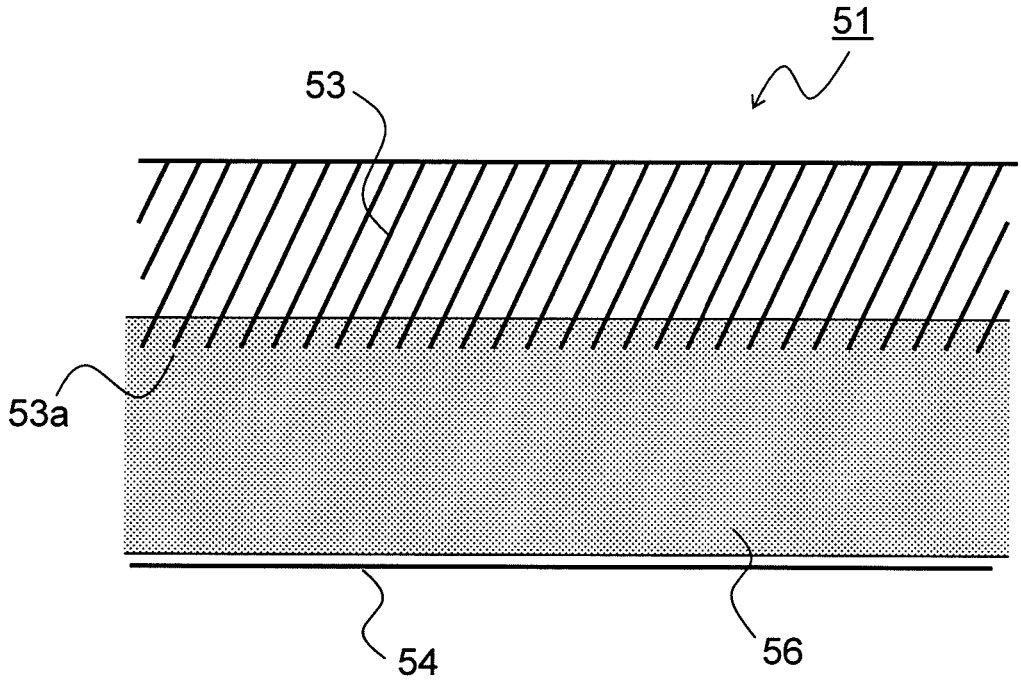
FIG. 8 is a partially enlarged view of the film member under a state in which a double-faced tape is applied so as to overlap proximal end portions of cuts in the toner dispersing member according to the first embodiment of the present invention.

Further, when the film member 51 is wound about the rotary shaft 47*a* so as to constitute the toner dispersing member 47, load is applied to the dispersing protrusions 47*b*, which leads to a risk that the cuts 53 further split and the dispersing protrusions 47*b* are torn off. As a countermeasure, when the double-faced tape 56 is applied to the fixation portion 54, as illustrated in FIG. 8, it is preferred that the double-faced tape 56 be applied so as to overlap proximal end portions 53*a* of the cuts 53. With this application, the proximal end portions 53*a* of the cuts 53 are reinforced by the double-faced tape 56. Thus, the dispersing protrusions 47*b* are prevented from being torn off.

Figure 9:
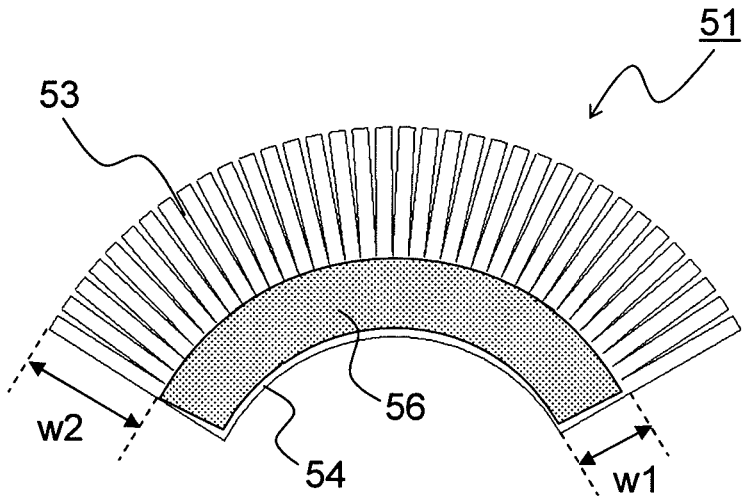
FIG. 9 is a developed view of a film member used for a toner dispersing member according to a second embodiment of the present invention.
Figure 10:
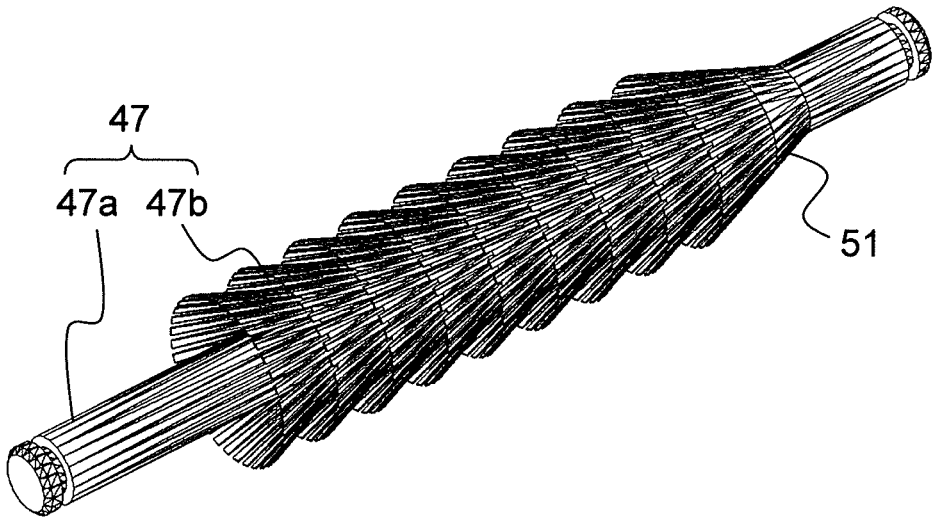
FIG. 10 is a perspective view of the toner dispersing member according to the second embodiment of the present invention.

FIG. 9 is a developed view of the dispersing protrusions used for the toner dispersing member according to a second embodiment of the present invention, and FIG. 10 is a perspective view of the toner dispersing member constituted by the dispersing protrusions of FIG. 9 wound about the rotary shaft. In this embodiment, the large number of cuts 53 are formed inward from an outer peripheral edge of the fan-like film member 51 as illustrated in FIG. 9, the fixation portion 54 includes an inner peripheral portion which is free from the cuts 53 of the film member 51, and the double-faced tape 56 is applied to the fixation portion 54. The dispersing protrusions 47*b* are formed of a plurality of film members 51 (nine in this case) conically wound about the rotary shaft 47*a* at a predetermined pitch.

Also in this embodiment, as in the first embodiment, there is no risk that foreign matter derived from the toner dispersing member 47 enters the developing container 30, and hence image failures such as a void image are effectively prevented.

In the toner dispersing member 47 in this embodiment, the dispersing protrusions 47*b* are constituted by the plurality of film members 51, and hence thickness and hardness (elasticity) of the film members 51 forming the dispersing protrusions 47*b* may be changed in one toner dispersing member 47. Accordingly, dispersion properties in the longitudinal direction of the toner dispersing member 47 may be arbitrarily adjusted. Further, when the dispersing protrusions 47*b* are partially deteriorated through temporal change and the like, it suffices that only the film member 51 corresponding to the deteriorated part is replaced. Thus, maintenance property of the toner dispersing member 47 is enhanced.

Note that, in the toner dispersing member 47 in this embodiment, a toner conveying force in the longitudinal direction of the toner dispersing member 47 is somewhat lower than that in the first embodiment in which the dispersing protrusions 47*b* are helically arranged. Thus, when an opening width of the toner discharge port 46*b* is increased so that toner is supplied from the entire region of the opening width, it is preferred to helically arrange the dispersing protrusions 47*b* as in the first embodiment.

Further, as in the first embodiment illustrated in FIG. 8, it is preferred that the double-faced tape 56 be applied so as to overlap the proximal end portions 53*a* of the cuts 53.

Figure 11A:
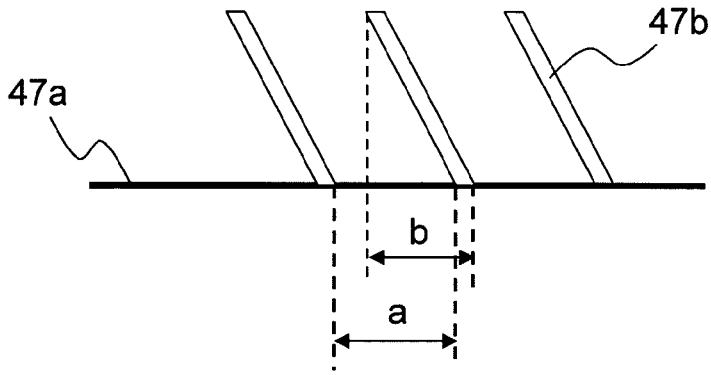
FIGS. 11A and 11B are partially enlarged views each illustrating a relation between a pitch a between dispersing protrusions in a direction of a rotary shaft of the toner dispersing member according to the second embodiment of the present invention and a projection length b of one of the dispersing protrusions with respect to the rotary shaft.
Figure 11B:
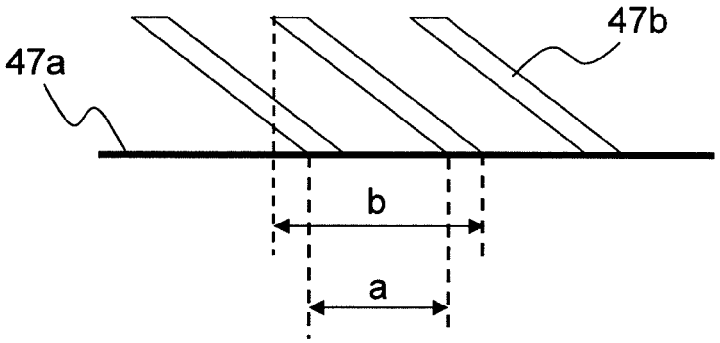

FIGS. 11A and 11B are enlarged sectional views of the dispersing member 47 according to the first embodiment. As illustrated in FIG. 11A, when a relation a≧b is established where "a" represents an interval (pitch) of the dispersing protrusions 47*b* in a thrust direction of the rotary shaft 47*a* and "b" represents a projection length of one of the dispersing protrusions 47*b* with respect to the rotary shaft 47*a* viewed from a perpendicular direction, there is a risk that the lump of toner injected from the toner injection port 46*a* passes through gaps among the dispersing protrusions 47*b* and is replenished from the toner discharge port 46*b* into the developing device 8 without being sufficiently dispersed.

In contrast, as illustrated in FIG. 11B, when a relation a<b is established, the lump of toner injected from the toner injection port 46*a* comes into contact with the dispersing protrusions 47*b* without fail, and is finely dispersed while being conveyed in the longitudinal direction of the dispersing member 47. Accordingly, it is preferred that the dispersing protrusions 47*b* be fixed to the rotary shaft 47*a* while being inclined with respect thereto by a predetermined amount so that the relation a<b is established. Note that, also in the second embodiment, by fixation of dispersing protrusions 47*b* so that the pitch a and the projection length b of the dispersing protrusions 47*b* satisfy the relation a<b as illustrated in FIG. 11B, the lump of toner may be efficiently dispersed by rocking of the dispersing protrusions 47*b* as in the structure in the first embodiment illustrated in FIG. 7.

Further, the density of the dispersing protrusions 47*b* increases in reverse proportion to the pitch a of the dispersing protrusions 47*b*, and a dispersible region of the dispersing protrusions 47*b* increases in proportion to the projection length b (brush length) of the dispersing protrusions 47*b*. Therefore, a toner dispersion effect increases. Accordingly, by a partial variation of the pitch a and the projection length b of the dispersing protrusions 47*b* in accordance with arrangement of the toner injection port 46*a* and the toner discharge port 46*b* of the housing 46, the toner dispersion effect of the toner dispersing mechanism 45 may be appropriately set.

The pitch a of the dispersing protrusions 47*b* may be adjusted by a change of a width w1 of the fixation portion 54 of the film member 51 (refer to FIGS. 6 and 9). Alternatively, in the case of the first embodiment, the pitch a may be adjusted also by a change of a winding angle of the film member 51 with respect to the rotary shaft 47*a*. Further, the projection length b of the dispersing protrusions 47*b* may be adjusted by a change of a length w2 of the cuts 53 of the film member 51 (refer to FIGS. 6 and 9).

Figure 12:
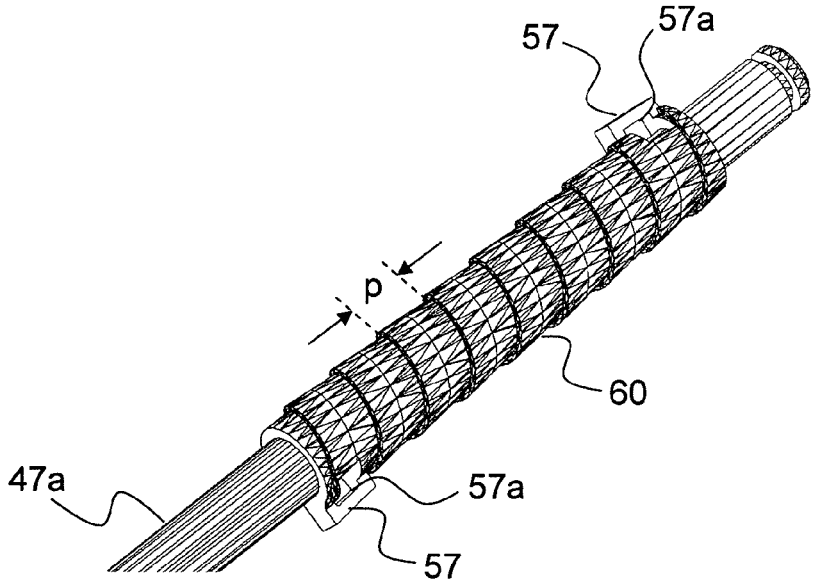
FIG. 12 is a perspective view of a rotary shaft used for a toner dispersing member according to a third embodiment of the present invention.
Figure 13:
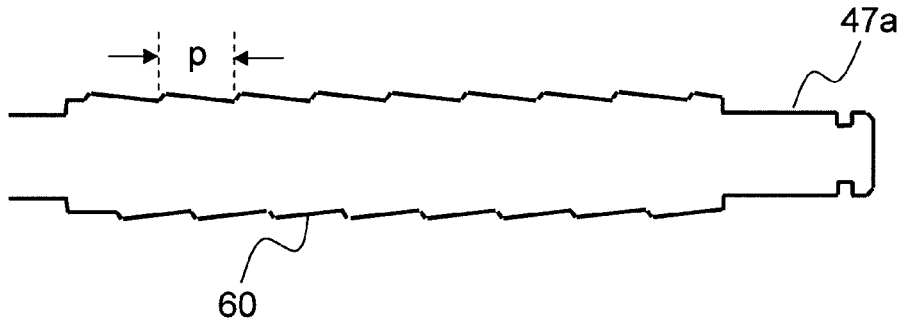
FIG. 13 is a longitudinal sectional view of the rotary shaft used for the toner dispersing member according to the third embodiment of the present invention.

FIG. 12 is a perspective view of a rotary shaft used for a toner dispersing member according to a third embodiment of the present invention, and FIG. 13 is a sectional view of the rotary shaft used for the toner dispersing member according to the third embodiment. The structure of the film member 51 is the same as that in the first embodiment illustrated in FIG. 6, and hence description thereof is omitted. In this embodiment, helical step portions 60 are formed to a part of the rotary shaft 47*a*, about which the film members 51 are wound. Further, a pitch p of the step portions 60 is substantially equal to the width w1 of the fixation portion 54 of the film member 51.

By winding of the film member 51 along the step portions 60 of the rotary shaft 47*a* illustrated in FIGS. 12 and 13, the film member 51 may be efficiently wound at a predetermined pitch. Thus, assembling workability of the toner dispersing member 47 is enhanced. Further, as illustrated in FIG. 12, the step portions 60 are inclined in an outer diameter direction of the rotary shaft 47*a*, and hence the cuts 53 are more easily widen when the film members 51 are wound. With this, the dispersing protrusions 47*b* may be raised at a wide angle with respect to the rotary shaft 47*a*.

Figure 14A:
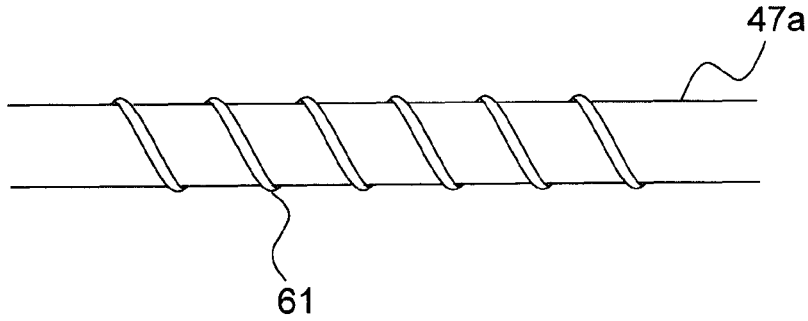
FIGS. 14A and 14B are side views each illustrating a modification of the rotary shaft used for the toner dispersing member according to the third embodiment of the present invention, in which a helical linear protrusion is provided on an outer peripheral surface of the rotary shaft in place of a step portion.
Figure 14B:
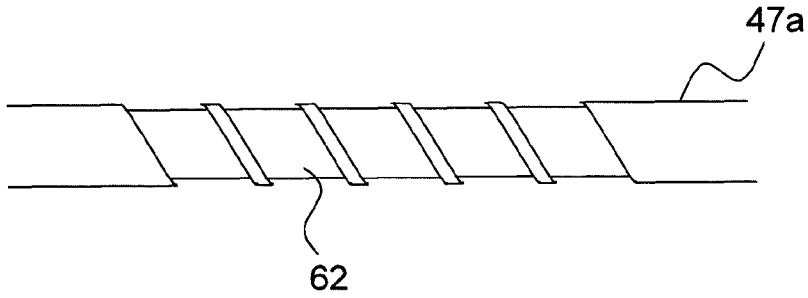
Figure 15:
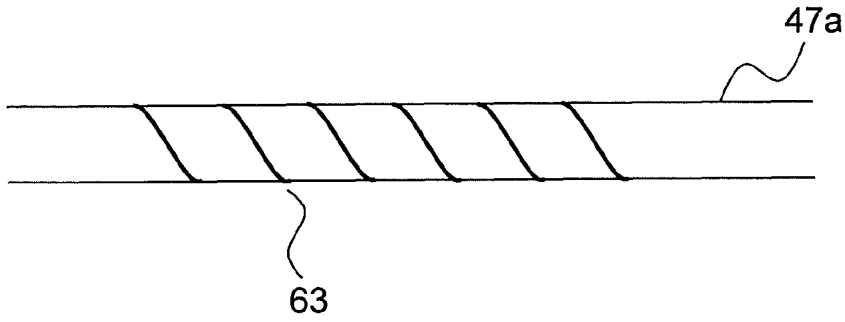
FIG. 15 is a side view illustrating a modification of the rotary shaft used for the toner dispersing member according to the third embodiment of the present invention, in which a helical linear mark is drawn on the outer peripheral surface of the rotary shaft in place of the step portion.

FIGS. 14A, 14B, and 15 are side views each illustrating a modification of the rotary shaft used for the toner dispersing member according to the third embodiment. The rotary shaft 47*a* illustrated in FIG. 14A is provided with a helical linear protrusion 61 in place of the step portions 60, and the toner dispersing member 47 is constituted by the film member 51 wound about parts partitioned by the linear protrusion 61. Further, the rotary shaft 47*a* illustrated in FIG. 14B is provided with helical recess portions 62 in place of the step portions 60, and the toner dispersing member 47 is constituted by the film member 51 wound about the recess portions 62. In those cases, although an effect of raising the dispersing protrusions 47*b* at a wide angle is not exerted like the case of the step portions 60, the film member 51 may be efficiently wound at a predetermined pitch as in the case of the step portions 60. Thus, assembling workability of the toner dispersing member 47 is enhanced.

Further, on the rotary shaft 47*a* illustrated in FIG. 15, a helical linear mark 63 is drawn by printing or the like in place of the step portions 60. Also in this case, although somewhat less than those in the cases of employing the step portions 60 and the linear protrusion 61, assembling workability of the toner dispersing member 47 is enhanced by winding of the film member 51 along the linear mark 63.

Figure 16:
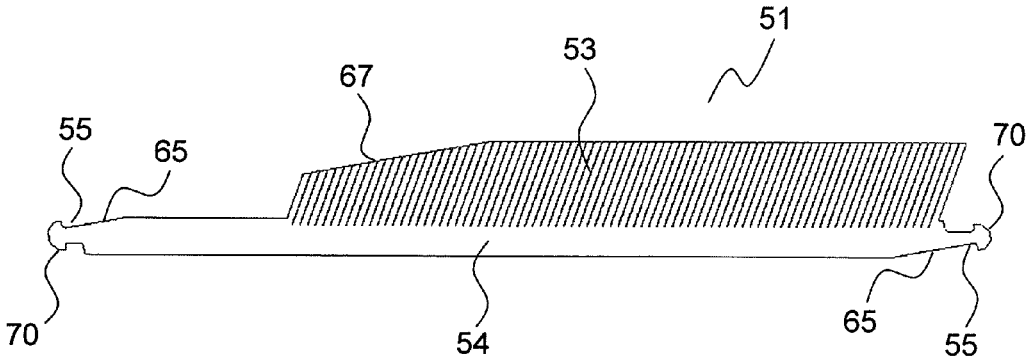
FIG. 16 is a developed view of a film member used for a toner dispersing member according to a fourth embodiment of the present invention.
Figure 17:
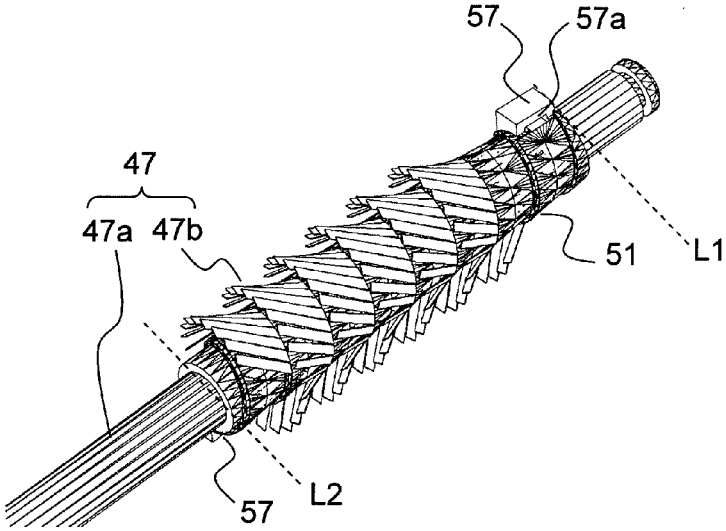
FIG. 17 is a perspective view of the toner dispersing member according to the fourth embodiment of the present invention.

FIG. 16 is a developed view of the dispersing protrusions used for the toner dispersing member according to a fourth embodiment of the present invention, and FIG. 17 is a perspective view of the toner dispersing member constituted by the dispersing protrusions of FIG. 16 helically wound about the rotary shaft. In this embodiment, the fixation portion 54 of the film member 51 is provided with first inclined portions 65 inclined to both end portions.

Further, at an end portion of the film member 51 in the axial direction in which the distal ends of the dispersing protrusions 47*b* are directed at a time of winding of the film member 51 about the rotary shaft 47*a* (winding base side), there is formed a second inclined portion 67 inclined in the same direction as that of one of the first inclined portions 65 by diagonal cutting of the distal ends of the cuts 53. In addition, at a distal end of each of the engagement protrusions 55 provided at both the end portions of the film member 51, there is formed a hook portion 70 wider than the slit 57*a* of each of the engagement portions 57 of the rotary shaft 47*a*.

According to the structure in this embodiment, the hook portion 70 formed at the distal ends of each of the engagement protrusions 55 reliably prevents the engagement protrusions 55 from being detached from the engagement portions 57. Further, the first inclined portions 65 formed in the fixation portion 54 of the film member 51 causes edges of a winding-start portion and a winding-end portion to respectively overlap straight lines L1 and L2 substantially perpendicular to the rotary shaft 47*a*. Accordingly, merely by fitting of the first inclined portions 65 substantially perpendicular to the rotary shaft 47*a*, the film member 51 may be easily positioned with respect to the rotary shaft 47*a*, which leads to enhancement of workability. Further, the hook portions 70 may be inserted substantially perpendicular to the engagement portions 57, and hence inserting operation is more easily performed.

Figure 18:
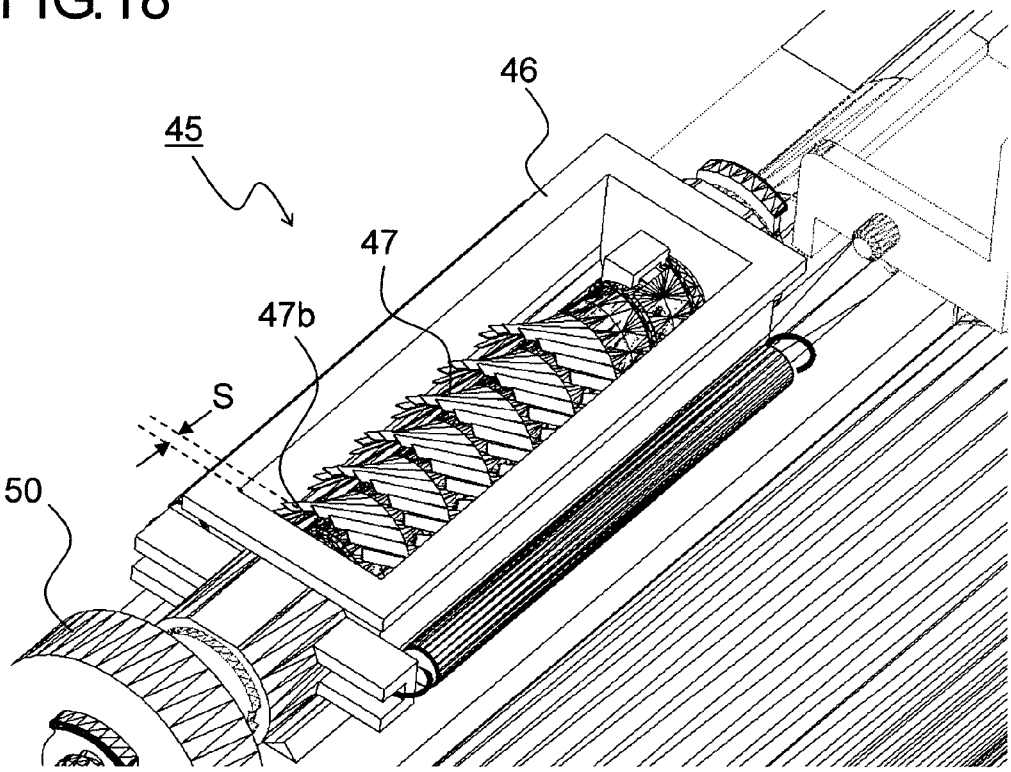
FIG. 18 is a perspective view of a toner dispersing mechanism provided with the toner dispersing member according to the fourth embodiment of the present invention.

Further, the second inclined portion 67 formed on a cut 53 side enables the distal ends of the dispersing protrusions 47*b* to be aligned with the straight line L2 at the edge on the winding base side. With this, as illustrated in FIG. 18, when the toner dispersing member 47 is arranged in the housing 46, a gap S between the distal ends of the dispersing protrusions 47*b* and an inner surface of the housing 46 may be minimized. Accordingly, a toner dispersion effect in the gap S may be increased. In addition, the dispersing protrusions 47*b* scrape off a lump of toner adhering to the inner surface of the housing 46, and hence generation of a toner pool may also be suppressed.

The present invention is not limited to the above-mentioned embodiments, and various modifications may be made thereto within the spirit of the present invention. For example, as a matter of course, the present invention encompasses structures obtained by appropriate combinations of the above-mentioned embodiments.

Note that, in each of the above-mentioned embodiments, the toner dispersing mechanism of the developing device is exemplified, in which the two-component developer including a magnetic carrier and toner is used, however, the present invention is applicable also to a developing device in which a one-component developer constituted only by toner is used. In addition, the toner dispersing member of the present invention is not limited to use for toner dispersion at a time of toner supply from the intermediate hopper 25 to the developing device 8, and may be used for other parts in the image forming apparatus, at which a lump of toner needs to be dispersed. For example, the toner dispersing member may be used for toner dispersion at a time of toner supply from the toner container 9 to the intermediate hopper 25.

Further, the image forming apparatus of the present invention is not limited to the digital multifunction apparatus as illustrated in FIG. 1, and it is needless to say that it is similarly applicable to another image forming apparatus such as a color copier, a monochrome printer, a color printer, and a facsimile.

The toner dispersing member according to the embodiments of the present invention are applicable to a toner dispersing mechanism of an image forming apparatus in which toner is replenished from a toner storage container such as a hopper and a container into a developing device. The present invention may provide a toner dispersing member which has a simple structure which is free from risks of bristle loss, tear-off, and the like.

Further, by arrangement of a toner dispersing mechanism provided with the toner dispersing member of the present invention between a toner storage container and a developing device, toner supplied from the toner storage container may be replenished into the developing device in a state of being sufficiently dispersed. Thus, an image forming apparatus may be provided, which is capable of effectively suppressing failures such as a density unevenness, fogging, and a void image which is caused by entry of foreign matter.

What is claimed is:

1. A toner dispersing member, comprising:

a rotary shaft; and dispersing protrusions formed of a flexible film member wound along an outer peripheral surface of the rotary shaft, the flexible film member being provided with a large number of cuts which are formed on one side of the flexible film member and are directed outward, wherein the toner dispersing member is rotated about the rotary shaft so that a lump of toner coming into contact with the dispersing protrusions is dispersed, the flexible film member has a ribbon-like shape in which the large number of cuts are formed on the one side of the flexible film member in a longitudinal direction, the dispersing protrusions are formed by winding the flexible film member helically along the outer peripheral surface of the rotary shaft, with another side of the flexible film member which is free from cuts being a fixation portion, the flexible film member includes engagement protrusions formed at both end portions of the flexible film member, and the rotary shaft includes engagement portions formed at two points on the outer peripheral surface of the rotary shaft and having slits into which the engagement protrusions are inserted.

2. A toner dispersing member according to claim 1, wherein the engagement protrusions have hook portions formed at distal ends of the engagement protrusions and being wider than the slits of the engagement portions.

3. A toner dispersing member according to claim 1, wherein the rotary shaft has a helical shape or a helical pattern formed on the outer peripheral surface of the rotary shaft in accordance with a winding position of the flexible film member.

4. A toner dispersing member according to claim 3, wherein the helical shape comprises a helical linear protrusion or a helical recess portion.

5. A toner dispersing member according to claim 3, wherein the helical shape comprises a helical step portion.

6. A toner dispersing member according to claim 5, wherein the step portion is inclined in an outer diameter direction of the rotary shaft.

7. A toner dispersing member according to claim 1, wherein the flexible film member includes first inclined portions formed at edges in the longitudinal direction of the fixation portion and inclined to both end portions of the flexible film member.

8. A toner dispersing member according to claim 1, wherein on an end portion side of the flexible film member in a direction in which distal ends of the dispersing protrusions are directed at a time of winding of the flexible film member about the rotary shaft, the flexible film member includes a second inclined portion formed at an edge of a part of the flexible film member and inclined to an end portion of the flexible film member, the part being provided with the large number of cuts.

9. A toner dispersing member according to claim 1, wherein:

the dispersing protrusions are fixed while being inclined with respect to an axial direction of the rotary shaft, and a projection length of each of the dispersing protrusions with respect to the rotary shaft is larger than a pitch of the dispersing protrusions in a direction of the rotary shaft.

10. A toner dispersing member according to claim 1, wherein a winding pitch of the flexible film member varies in a direction of the rotary shaft.

11. A toner dispersing member according to claim 10, wherein a width of the fixation portion varies in the direction of the rotary shaft.

12. A toner dispersing member according to claim 1, wherein a projection length of each of the dispersing protrusions with respect to the rotary shaft varies in a direction of the rotary shaft.

13. A toner dispersing member according to claim 12, wherein a length of each of the large number of cuts provided to the flexible film member varies in the direction of the rotary shaft.

14. A toner dispersing member according to claim 1, wherein the flexible film member is fixed to the rotary shaft through use of a tape-like attachment member having a pressure-sensitive adhesive layer or an adhesive layer on both surfaces thereof, the tape-like attachment member being arranged so as to overlap proximal end portions of the large number of cuts.

15. A toner dispersing member, comprising:

a rotary shaft; and dispersing protrusions formed of a flexible film member wound along an outer peripheral surface of the rotary shaft, the flexible film member being provided with a large number of cuts which are formed on one side of the flexible film member and are directed outward, wherein the toner dispersing member is rotated about the rotary shaft so that a lump of toner coming into contact with the dispersing protrusions is dispersed, the flexible film member comprises a plurality of flexible film members each having a fan-like shape in which the large number of cuts are formed from an outer peripheral edge to an inner peripheral edge, and the dispersing protrusions are formed by winding the plurality of flexible film members conically about the rotary shaft at a predetermined pitch, with an inner peripheral side of each of the flexible film members which is free from cuts being a fixation portion.

16. A toner dispersing mechanism comprising:

a toner dispersing member including a rotary shaft, and dispersing protrusions formed of a flexible film member wound along an outer peripheral surface of the rotary shaft, the flexible film member being provided with a large number of cuts which are formed on one side of the flexible film member and are directed outward, wherein the toner dispersing member is rotated about the rotary shaft so that a lump of toner coming into contact with the dispersing protrusions is dispersed; and a housing rotatably supporting the toner dispersing member, and provided with a toner injection port communicating with a toner storage container, and a toner discharge port communicating with a developing device.

17. A toner dispersing mechanism according to claim 16, wherein the dispersing protrusions each have a distal end held in contact with an opening rim of the toner discharge port.

* * * * *